United States Patent [19]

Demuth et al.

[11] Patent Number: 5,044,045

[45] Date of Patent: Sep. 3, 1991

[54] METHOD OF, AND APPARATUS FOR, EXTRACTING FIBER FLOCKS FROM FIBER BALES

[75] Inventors: Robert Demuth, Nuerensdorf; Jürg Faas, Dinhard; Peter Brütsch, Neuhausen; Paul Stäheli, Wilen b. Wil; Janusz Konaszweski, Winterthur, all of Switzerland

[73] Assignee: Maschinenfabrik Rieter AG, Winterthur, Switzerland

[21] Appl. No.: 487,889

[22] Filed: Mar. 5, 1990

[30] Foreign Application Priority Data

Mar. 7, 1989 [CH] Switzerland ..... 834/89

[51] Int. Cl.[5] ..... D01G 7/06; D01G 7/10

[52] U.S. Cl. ..... 19/80 R; 19/81

[58] Field of Search ..... 19/80 R, 81

[56] References Cited

U.S. PATENT DOCUMENTS

| | | | |
|---|---|---|---|
| 3,139,650 | 7/1964 | Diesel | 19/80 R |
| 3,251,096 | 5/1966 | Rapp | 19/80 R |
| 3,537,143 | 11/1970 | Merck | 19/80 R |
| 3,686,714 | 8/1972 | Wirth | 19/80 R |
| 3,736,624 | 6/1973 | Alt et al. | 19/80 R |
| 3,795,943 | 3/1974 | Eckrodt | 19/80 R |
| 4,193,169 | 3/1980 | Olsson | 19/80 R |
| 4,377,021 | 3/1983 | Peters | 19/80 R |
| 4,513,479 | 4/1985 | Binder et al. | 19/81 |
| 4,566,152 | 1/1986 | Zuend | 19/81 |
| 4,660,257 | 4/1987 | Binder et al. | 19/81 |
| 4,813,103 | 3/1989 | Walk et al. | 19/80 R |

FOREIGN PATENT DOCUMENTS

| | | | |
|---|---|---|---|
| 0372885 | 8/1989 | European Pat. Off. . | |
| 1137359 | 9/1962 | Fed. Rep. of Germany . | |
| 2053948 | 6/1972 | Fed. Rep. of Germany | 19/80 R |
| 2442672 | 5/1975 | Fed. Rep. of Germany | 19/80 R |
| 8712308 | 2/1989 | Fed. Rep. of Germany . | |
| 503809 | 4/1971 | Switzerland . | |
| 386035 | 10/1973 | U.S.S.R. | 19/80 R |
| 1335582 | 9/1987 | U.S.S.R. | 19/80 R |
| 437242 | 10/1935 | United Kingdom | 19/80 R |

*Primary Examiner*—Werner H. Schroeder
*Assistant Examiner*—John J. Calvert
*Attorney, Agent, or Firm*—Sandler, Greenblum & Bernstein

[57] ABSTRACT

In order to extract fiber flocks from fiber bales conveyed on a conveyor belt by very small steps in a predetermined direction of travel, an extraction member is moved over the fiber bales in a direction substantially perpendicular to the predetermined direction of travel of the fiber bales. For this purpose, the extraction member comprises a spiked opening roller driven by a motor. This spiked opening roller conveys, by rotary motion thereof, fiber flocks from the surface of the fiber bales into a fiber-flock conveying channel, in which the fiber flocks are drawn off by a fan and delivered to a conveyor channel. In this conveyor channel, which is likewise a suction fiber-flock conveying channel, the fiber flocks are fed via a connecting line or conduit to a fiber-flock processing location. For moving the extraction member over the fiber bales, the extraction member is provided with wheel shafts and wheels having a profiled tread for guidance along tube-shaped tracks. The wheel shafts are driven by a motor and an associated gearing. A control unit synchronizes the step-by-step forward travel of the fiber bales in the aforesaid predetermined direction of travel with the travel of the extraction member over the fiber bales.

45 Claims, 3 Drawing Sheets

METHOD OF, AND APPARATUS FOR, EXTRACTING FIBER FLOCKS FROM FIBER BALES

BACKGROUND OF THE INVENTION

The present invention broadly relates to removing flocks from fiber bales and pertains, more specifically, to a new and improved method of extracting fiber flocks from fiber bales by moving an extraction or opening member, preferably a spiked or toothed opening roller or roll provided with tooth-like spikes or teeth, over an extraction or removal surface of fiber bales serially disposed in a row on a supporting surface. The extraction member is part of a bale-opener machine and rotates about an axis of rotation, and the tooth-like spikes of the spiked or toothed opening roller extract fiber flocks from the extraction or removal surface and deliver the fiber flocks to a flock transportation means. The fiber bales arranged in a row having a predetermined longitudinal direction are moved by steps or increments toward the bale-opener machine for further fiber-flock extraction. The present invention also relates to a new and improved apparatus for extracting fiber flocks from fiber bales.

In a spinning mill, the supplied fiber bales are first unwrapped or stripped of their packaging or the like and then directly delivered to an opening or cleaning room in which the fiber bales are opened or loosened into fiber flocks.

This opening operation was carried out in an early generation of bale-opener machines in that spinning-mill personnel opened the fiber bales in layers and placed the layers on a conveyor belt or band for delivery to a layer-opening apparatus, which in most cases was a lattice apron.

The operating personnel also fulfilled the task of proportionally extracting fiber layers from a plurality of different fiber bales according to a predetermined proportion or ratio and, furthermore, of layering these extracted different fiber layers one upon the other, so that the layer-opening apparatus was supplied with a fiber-flock mixture to be opened.

However, this former method of bale opening had the disadvantage that the fiber-flock mixture was very inaccurate and, moreover, was dependent on the work discipline or dexterity of the operating personnel.

A further disadvantage of this former method is seen in the fact that the outer fiber layers of the fiber bales possess a substantially looser coherence or compactness than the inner fiber layers of the fiber bales, with the result that the inaccuracy of the fiber-flock mixture was even increased to a greater extent due to variations in the density or compactness of the individual fiber-flock layers.

Such disadvantages and quality problems called for the provision of an extraction method which is more accurate and less dependent on manual labor. A substantially improved method of, and apparatus for, extracting fiber flocks is disclosed, for example, in Swiss Patent No. 503,809, published Apr. 15, 1971.

In this prior art apparatus for extracting fiber flocks from fiber bales, the fiber bales are serially disposed in a row on the supporting surface of a conveyor belt or band and opened by a substantially horizontal fiber-extraction member which is perpendicularly oriented to the row of fiber bales.

In an embodiment of this prior art apparatus disclosed in the aforesaid Swiss Patent No. 503,809, the fiber-extraction member is movable on tracks along the row of fiber bales in such a manner that the so-called extraction or removal surface of the fiber bales, within which the fiber flocks are extracted, is not parallel to the aforesaid support surface of the conveyor belt or band. In other words, the extraction surface forms or defines a so-called angle of inclination with the supporting surface.

Since the extraction member is always moved back and forth in the same path of travel, it is thus achieved that the fiber bales can be advanced by means of a conveyor belt or band such that a predetermined bale stock or supply can be stored on the conveyor belt or band.

A disadvantage of this prior art bale opener is that only a small and limited number of different bales, i.e. bales of different provenances or origins, can be simultaneously opened, so that only a limited number of fiber bales per conveyor belt or band is available for the fiber-stock mixture. Consequently, it is necessary to provide several parallel operating bale-opener machines in the event of mixing fiber flocks from a larger number of fiber bales, for example, ten fiber bales.

This disadvantage was overcome by a later generation of bale-opener machines comprising a fiber-extraction member which likewise contains a substantially horizontal extraction roller which is perpendicularly oriented to a row of fiber bales. This flock extraction roller moves to-and-fro over the surface of serially arranged stationary fiber bales and thereby extracts or loosens fiber flocks from the extraction surface of the fiber bales, the extracted fiber flocks being delivered to flock transportation means. Such a bale-opener machine has been marketed world-wide under the trademark "UNIFLOC" by the assignee Rieter Machine Works Limited, located in Winterthur, Switzerland and is disclosed, for example, in European Patent No. 093,235, published July 3, 1985 and the cognate U.S. Pat. No. 4,566,152, granted Jan. 28, 1986.

However, this improved method of removing flocks from fiber bales described in the aforesaid European Patent No. 093,235 and the cognate U.S. Pat. No. 4,566,152 still is associated with the disadvantage that, for a given extraction or penetration depth of a flock removal member, a different or variable extraction performance is achieved during each pass over the fiber bales depending on the height of the latter, since the density or compactness of the fiber flocks in the outer bale layers, i.e. in the upper and lower bale regions, is substantially lower than in the inner bales layers, i.e. in the middle bale region.

This disadvantage or drawback was eliminated by a method of and a control arrangement for a machine for extracting fiber flocks from textile fiber bales as described, for example, in European Patent Application No. 0,193,647, published Sept. 10, 1986 and the cognate U.S. Pat. No. 4,660,257, granted Apr. 28, 1987. According to this prior art method, the penetration depth of the extracting member into the bales is gradually reduced while operating in an upper bale region during a predetermined number of passes from a predetermined maximum value to a lesser penetration depth value predetermined for a middle bale region. The penetration depth is then maintained constant at the lesser penetration depth value while operating in the middle bale region. Finally, the penetration depth is gradually increased while operating in a lower bale region to a maximum penetration depth. The lowering of the extracting member in discrete increments having magnitudes determined by gradually reducing or increasing the penetration depth is effected by a suitable automatic control unit.

However, a disadvantage of the method of extracting fiber flocks by means of an extracting member moving along a row of fiber bales is seen in the fact that the stock or supply of further fiber bales has to be provided as a second row of bales arranged in parallel or in series to the first row of fiber bales being momentarily processed. In the case of a parallel arrangement of a second or reserve row of fiber bales, there would be required a turret mechanism containing the extracting member rotatable through an angle of 180°.

In a further method of, and apparatus for, mixing and opening fiber bales disclosed, for example, in German Patent No. 1,193,844, published May 26, 1965, individual layers of raw or crude fiber bales to be mixed are layered one upon the other to form a square-shaped pile which is horizontally conveyed between two lateral needle-type conveyor belts and between an upper needle-type conveyor belt and a lower needle-type conveyor belt toward an extraction carriage comprising two substantially vertical spiked opening rollers and moving horizontally to and fro over the entire front surface area of the layer pile, the thereby extracted fiber flocks being delivered in free fall to a further opening apparatus.

The disadvantage or drawback of such a bale-opener machine is the requirement of supplying a pile of different layers which can only be provided in an inaccurate mixing proportion or ratio.

SUMMARY OF THE INVENTION

Therefore, with the foregoing in mind, it is a primary object of the present invention to provide a new and improved method of, and apparatus for, extracting fiber flocks from fiber bales, which method and apparatus do not suffer from the aforementioned drawings and shortcomings of the prior art.

Another and more specific object of the present invention aims at providing a new and improved method of, and apparatus for, extracting fiber flocks from fiber bales, by means of which method and apparatus fiber bales are continuously opened in a simple manner and a flock mixture as homogeneous as possible is thereby obtained from different fiber-bale provenances or origins.

Now in order to implement these and still further objects of the present invention which will become more readily apparent as the description proceeds, the inventive method of extracting fiber flocks from fiber bales or the like is manifested, among other things, by the steps of orienting the axis of rotation of the spiked or toothed opening roller or roll with respect to the supporting surface for the serially disposed fiber bales such that the axis of rotation of the spiked or toothed opening roller or roll forms a predetermined nonzero angle of inclination with the supporting surface for the serially disposed fiber bales, i.e. an angle of inclination which differs from zero degrees, and determining the direction of travel of the extraction member over the extraction surface of the fiber bales disposed on the supporting surface such that the direction of travel of the extraction member is substantially transverse to the predetermined longitudinal direction of the row of fiber bales.

As alluded to above, the invention is not only concerned with the aforementioned method aspects, but also relates to a new and improved apparatus for performing and carrying out the inventive method for extracting fiber flocks from fiber bales.

In its more particular aspects, the new and improved apparatus for extracting fiber flocks from fiber bales comprises an extraction member which for the extraction of fiber flocks is reciprocatingly movable along a guidance or guide means and over an extraction surface of the fiber bales, and a supporting surface for the fiber bales which is movable in a predetermined direction of travel.

The inventive apparatus for extracting fiber flocks from fiber bales is manifested, among other things, by the features that the guidance of the extraction member is oriented in a direction which is substantially transverse to the aforesaid predetermined direction of travel of the supporting surface for the fiber bales, so that the reciprocating movement of the extraction member is substantially perpendicular to the predetermined direction of travel of the movable supporting surface for the fiber bales.

An advantage of the invention is seen in the fact that, according to the arrangement or formation of the row of fiber bales, fiber flocks are extracted from the upper region of a number of fiber bales or simultaneously extracted from the entire upper region of the fiber bales, and that at the same time, with the possibility of arranging rows of fiber bales directly next or adjacent to one another, there is the possibility of obtaining a fiber-flock mixture. Furthermore, compared with, for example, the apparatus disclosed in the aforementioned Swiss Patent No. 503,809, there is the advantage that the extracted fiber flocks can be further conveyed in the simplest possible manner.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have been generally used the same reference characters to denote the same or analogous components and wherein.

DETAILED DESCRIPTION OF THE PREFERRED EMBODIMENTS

Describing now the drawings, it is to be understood that to simplify the showing thereof, only enough of the construction of the exemplary embodiments of apparatus for extracting or removing fiber flocks from fiber bales has been illustrated therein as is needed to enable one skilled in the art to readily understand the underlying principles and concepts of this invention.

Figure 1:
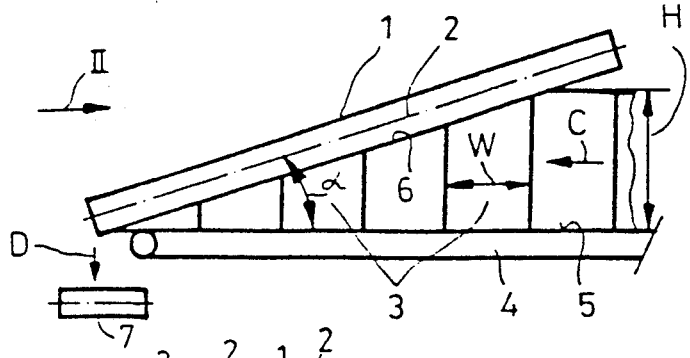
FIG. 1 schematically shows a side view of a first embodiment of apparatus constructed according to the invention, as viewed in the direction of the arrow I indicated in FIG. 2.
Figure 2:
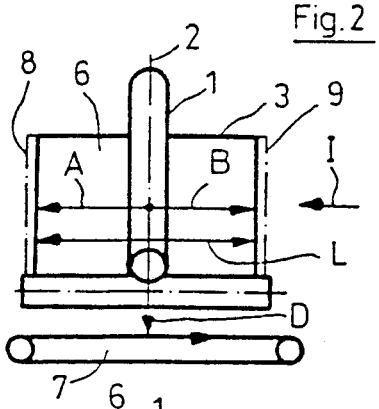
FIG. 2 schematically shows a front view of the apparatus depicted in FIG. 1, as viewed in the direction of the arrow II indicated in FIG. 1.

Turning attention now specifically to FIGS. 1 and 2 of the drawings, there have been illustrated therein by way of example and not limitation and in the interest of clearly illustrating the inventive method, only the essential elements or components of a first exemplary embodiment of apparatus for carrying out the inventive method.

A spiked or toothed opening roller or roll 1 depicted in FIG. 1 is provided and may be of the type disclosed and described, for example, in European Patent No. 058,781, published Sept. 1, 1982. This spiked or toothed opening roller or roll 1 has an axis of rotation 2 and is rotatably mounted in an extraction or opening member which will be described hereinafter.

The spiked or toothed opening roller 1 is reciprocatingly moved in the directions of to-and-fro travel A and B (FIG. 2) by means of a drive mechanism which will be referred to in greater detail hereinbelow. The to-and-fro motion of the spiked or toothed opening roller 1 serves the purpose of extracting fiber flocks from fiber bales 3 which are serially placed or arranged in a row on a conveyor belt or band 4. The surface of the conveyor belt or band 4, upon which the fiber bales 3 are placed or deposited, is conveniently designated as the supporting surface 5, while the surface at the fiber bales 3 resulting from the reciprocatingly moved spiked or toothed opening roller 1 and from the extraction of fiber flocks, respectively, is conveniently designated as the extraction surface 6.

In order to be able to continuously extract fiber flocks from the extraction surface 6 by means of the reciprocatingly moving spiked or toothed opening roller 1, the conveyor belt or band 4 is progressively moved by very small steps or increments in a predetermined direction of travel or conveyance C. Subsequent to each pass or passage of the spiked or toothed opening roller 1 in either one of the two directions of to-and-fro travel A and B, respectively, the conveyor belt or band 4 is moved by a discrete step toward the spiked or toothed opening roller 1. After terminating the opening or extraction process, the conveyor belt or band 4 is slightly rearwardly moved by a predetermined distance, for instance by 10 mm to 20 mm, in a predetermined direction away from the spiked or toothed opening roller 1, so that with certainty no fiber flocks are extracted from the respective row of fiber bales 3, even if, as described hereinafter, fiber flocks are still extracted from parallel arranged rows of bales 3.

The fiber flocks extracted or removed by the spiked or toothed opening roller 1 are delivered onto a conveyor belt or band 7, such discharge operation being symbolically designated by the reference character D. The actual discharge apparatus will be described hereinafter in greater detail. Instead of the conveyor belt or band 7, other conveying elements or conveyances can also be advantageously employed to receive the extracted fiber flocks, as will be described hereinbelow.

As further depicted in FIG. 1, the axis of rotation 2 of the spiked or toothed opening roller 1 forms or defines with the supporting surface 5 a so-called angle of inclination $\alpha$ in the range of, for example, 10° to 45° and preferably between 25° and 35°. This angle of inclination $\alpha$ can vary according to the type of apparatus, as illustrated, for example, by the angles of inclination $\alpha_1$ and $\alpha_2$ in FIG. 3, which are, for example, between 45° and 170° and preferably between 45° and 120°.

Furthermore, as can be seen from FIGS. 1 and 2, the fiber bales 3 are placed or deposited such that the bale length L is oriented in a direction substantially transverse to the direction of travel or conveyance C of the conveyor belt or band 4 and of the fiber bales 3, respectively. The fiber bales 3 are supported in upright position at the supporting surface 5 in that the bale height H is substantially vertical and, accordingly, the bale width W is aligned in the direction of travel or conveyance C.

Figure 3:
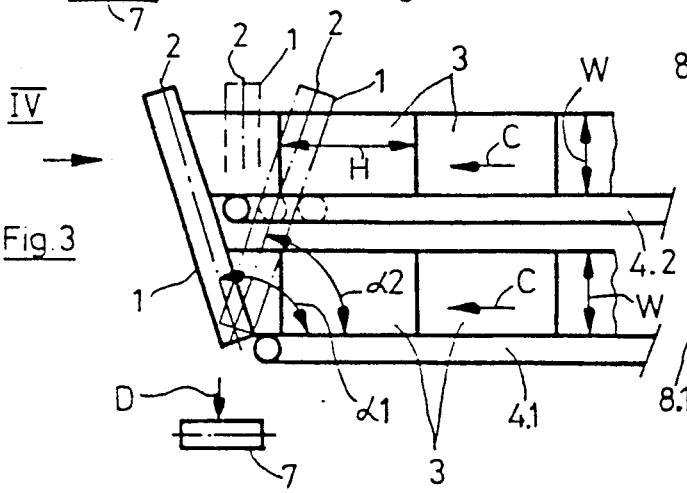
FIG. 3 schematically shows a side view of a second embodiment of apparatus constructed according to the invention, as viewed in the direction of the arrow III indicated in FIG. 4.

FIG. 3 shows a side view of a second exemplary embodiment of the apparatus constructed according to the invention. The spiked or toothed opening roller 1 is arranged with respect to the supporting surface 5 at the substantially larger angles of inclination $\alpha_1$ or $\alpha_2$, respectively. The spiked or toothed opening roller 1 indicated in broken or dashed lines forms or defines, for example, a right angle with the supporting surface 5 of the conveyor belt or band 4.

The advantage of this second exemplary embodiment is the possibility of arranging two individual conveyor belts or bands 4 one above the other. For reasons of clarity, reference characters 4.1 and 4.2 have been used in FIG. 3 to denote the lower conveyor belt or band and the upper conveyor belt or band, respectively.

The bale height H and the bale width W shown in FIG. 3 illustrate that the fiber bales 3 are horizontally arranged at the conveyor belts or bands 4.1 and 4.2, while the bale length L remains oriented in the direction substantially transverse to the direction of travel or conveyance C of the conveyor belts or bands 4.1 and 4.2. For all other elements in FIG. 3, there have been generally used the same reference numerals and characters to denote the same or analogous components depicted in FIGS. 1 and 2.

Figure 4:
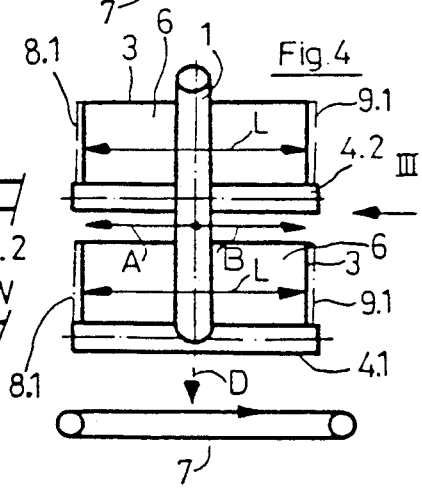
FIG. 4 schematically shows a front view of the apparatus depicted in FIG. 3, as viewed in the direction of the arrow IV indicated in FIG. 3.

FIGS. 2 and 4 also show that the fiber bales 3 arranged at the conveyor belts or bands 4, 4.1 and 4.2 can be advantageously guided by lateral walls 8 and 9 (FIG. 2) and lateral walls 8.1 and 9.1 (FIG. 3). This optional arrangement of lateral walls is indicated by means of dash-dot lines.

Figure 5:
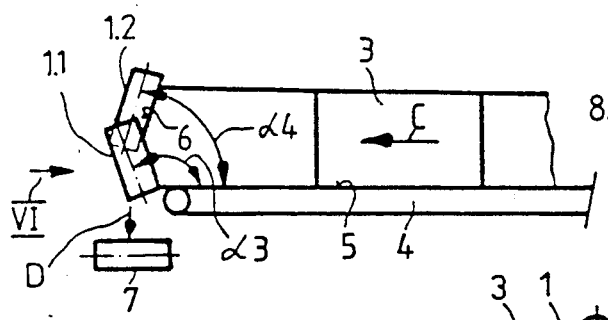
FIG. 5 schematically shows a side view of a third embodiment of apparatus constructed according to the invention, as viewed in the direction of the arrow V indicated in FIG. 6.
Figure 6:
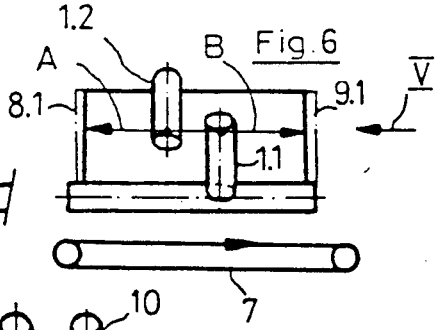
FIG. 6 schematically shows a front view of the apparatus depicted in FIG. 5, as viewed in the direction of the arrow VI indicated in FIG. 5.

FIG. 5 shows a side view of a third exemplary embodiment of the apparatus constructed according to the invention. Two spiked or toothed opening rollers, namely a lower spiked or toothed opening roller 1.1 and an upper spiked or toothed opening roller 1.2 depicted in FIGS. 5 and 6, are adjacently arranged in such a manner that they form two different angles of inclination, namely the angle of inclination $\alpha_3$ between the lower spiked or toothed opening roller 1.1 and the conveyor belt or band 4, and the angle of inclination $\alpha_4$ between the upper spiked or toothed opening roller 1.2 and the conveyor belt or band 4. The angles $\alpha_3$ and $\alpha_4$ may be in a range between 10° and 170°.

This arrangement of the spiked or toothed opening rollers 1.1 and 1.2 has the advantage that the two spiked or toothed opening rollers 1.1 and 1.2 produce respective shearing force components which act in opposite or opposed directions during fiber-flock extraction by these two spiked or toothed opening rollers 1.1 and 1.2 at the extraction surface 6 of the fiber bales 3. The shearing force component is due to the inclination of the respective spiked or toothed opening roller. In the case of an angle of inclination smaller than 90°, the shearing force component acts in the downward direction. If the angle of inclination exceeds 90°, the shearing force component acts in the upward direction. In other words, the two shearing force components occurring in the arrangement of the two spiked or toothed opening rollers 1.1 and 1.2 substantially compensate one another.

Figure 7:
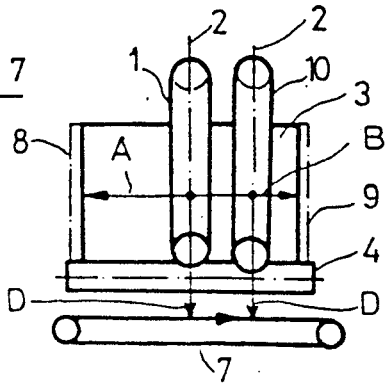
FIG. 7 schematically shows a front view of a constructional variant of the apparatus depicted in FIG. 2.

FIG. 7 illustrates a constructional variant of the apparatus depicted in FIG. 2 in that a second spiked or toothed opening roller 10 is provided in parallel relationship to the spiked or toothed opening roller 1.

In operation, the two spiked or toothed opening rollers 1 and 10 can rotate, during each pass thereof in either one of the two directions of to-and-fro travel A and B, in the same or identical direction of rotation or in opposite directions of rotation. It is thereby known that, for extracting fiber flocks from the extraction surface of a fiber bale, the direction of rotation should be determined such that a so-called down-milling process is possible in that the direction of rotation of the two spiked or toothed opening rollers 1 and 10 at the extraction surface 6 is codirectional with the respective direction of travel of the spiked or toothed opening rollers 1 and 10. In a so-called up-milling process, i.e. when the direction of rotation of the spiked or toothed opening rollers 1 and 10 at the extraction surface 6 is oriented against the respective direction of travel of the spiked or toothed opening rollers 1 and 10, there is achieved a lower extraction yield or output per pass in either one of the two directions of to-and-fro travel A and B of the spiked or toothed opening rollers 1 and 10. However, it can occur that fiber layers of the fiber bales 3 are too strongly lifted or shifted in a down-milling process, so that it would be expedient to compensate such undesired shifts of fiber layers by determining that the direction of rotation of one of the two spiked or toothed opening rollers 1 and 10 at the extraction surface 6 is oriented in each case against the directions of to-and-fro travel A and B, respectively.

The removal of extracted fiber flocks is also schematically depicted in FIG. 7 by the arrows D. Furthermore, as mentioned hereinbefore, the conveyor belt or band 7 can be replaced by any other convenient or suitable conveyance. For all other elements in FIG. 7, there have been generally used the same reference numerals to denote the same or analogous components depicted in FIGS. 1 through 6.

Figure 8:
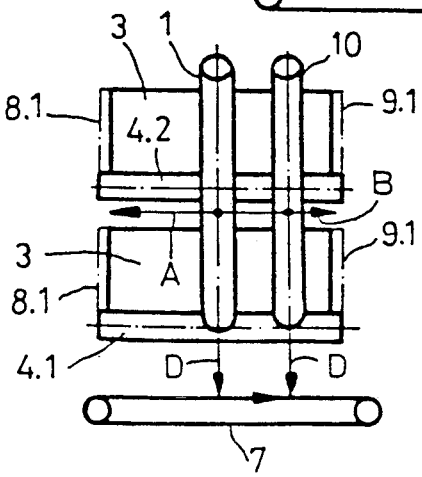
FIG. 8 schematically shows a front view of a constructional variant of the apparatus depicted in FIG. 4.

FIG. 8 shows the inventive feature of the apparatus depicted in FIG. 7. However, there are provided two conveyor belts or bands 4.1 and 4.2 which are arranged in stacked or superposed formation. The provision of two spiked or toothed opening rollers corresponds with the use of the two spiked or toothed opening rollers 1 and 10 of the embodiment depicted in FIG. 7, so that the same reference numerals have been generally used to denote the same or analogous components depicted in FIGS. 4 and 7.

Figure 9:
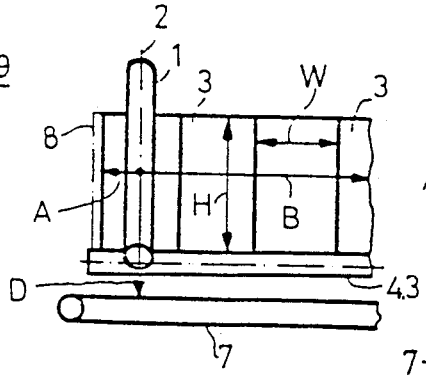
FIG. 9 schematically shows a front view of a variant of employing the apparatus depicted in FIG. 2.

FIG. 9 shows the arrangement of the spiked or toothed opening roller 1 depicted in FIG. 2. However, the arrangement of the fiber bales 3 is at right angles to the arrangement of the fiber bales 3 depicted in FIG. 2. In other words, the bale length L is oriented in the direction of travel or conveyance C, so that several fiber bales 3 with their bale width W arranged next or adjacent to one another require less travel per pass in the directions of to-and-fro travel A and B. The substantially wider conveyor belt or band is conveniently designated by the reference numeral 4.3.

Figure 10:
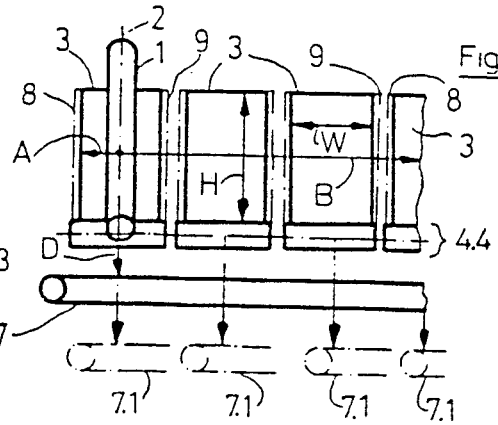
FIG. 10 schematically shows a front view of a further variant of employing the apparatus depicted in FIG. 2.

The apparatus depicted in FIG. 10 comprises the same fiber-bale arrangement as shown in FIG. 9. However, each row of fiber bales 3 is provided with a separate individual conveyor belt or band 4.4. The advantage of this fiber bale arrangement is seen in the fact that the individual rows of fiber bales 3 can be moved per pass of the spiked or toothed opening roller 1 over the fiber bales 3, i.e. from one of the passes to the next, with different advance movement in the direction of travel or conveyance C. In this manner, the extraction or penetration depth, which results from the advance movement in the direction of travel or conveyance C for each pass of the spiked or toothed opening roller 1 in either one of the two directions of to-and-fro travel A and B, can be adapted to the different provenances of the fiber bales 3 on the respective conveyor belts or bands 4.4.

The reference numeral 7.1 conveniently indicates that the fiber flocks extracted from the individual rows of fiber bales 3 can be delivered to respective individual conveyor belts or bands 7.1 instead of to the common conveyor belt or band 7.

Figure 11:
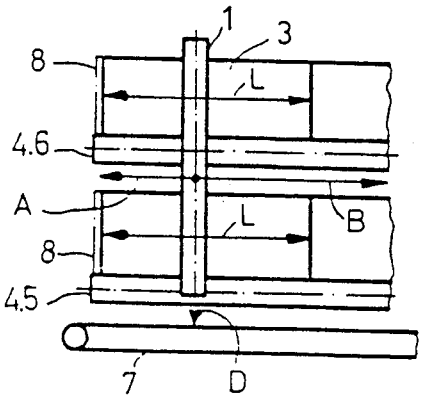
FIG. 11 schematically shows a front view of a variant of employing the apparatus depicted in FIG. 4.

FIG. 11 shows the second exemplary embodiment depicted in FIG. 4. However, the provision of several fiber bales 3 arranged side by side requires correspondingly wider conveyor belts or bands 4.5 and 4.6.

Figure 12:
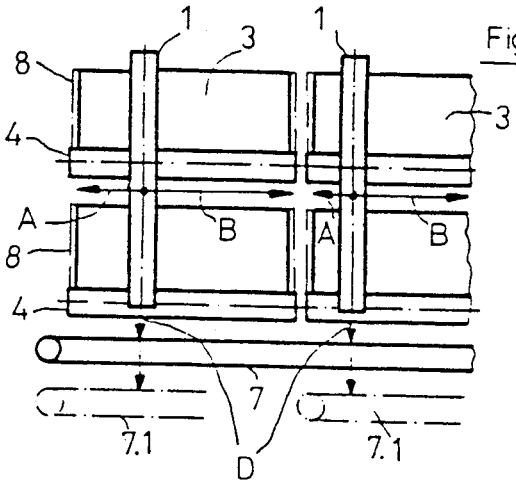
FIG. 12 schematically shows a front view of a further variant of employing the apparatus depicted in FIG. 4.

An arrangement similar to the variants depicted in FIGS. 10 and 11 is schematically shown in FIG. 12. Individual conveyor belts or bands 4 are provided for the rows of fiber bales 3 arranged side by side. The advantage of this arrangement is identical with the advantage of the arrangement depicted in FIG. 10, although in this case the individual conveyor belts or bands 4 are arranged in stacked or superposed formation.

Figure 13:
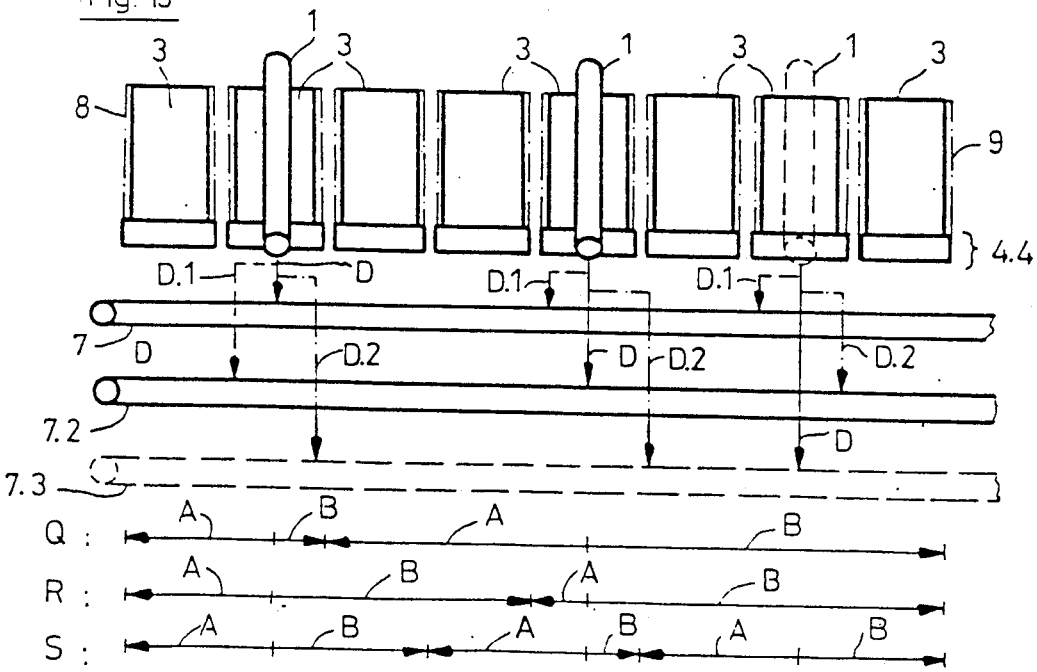
FIG. 13 schematically shows a front view of a variant for extended use of the apparatus depicted in FIG. 10.

FIG. 13 schematically shows an arrangement, as depicted in FIG. 10, with a conveyor belt or band 4.4 for each row of fiber bales 3, but provided with more than one spiked or toothed opening roller 1 for the plurality of rows of fiber bales 3. A spiked or toothed opening roller 1 shown in broken lines indicates that there can be two or more than two spiked or toothed opening rollers 1. This actually applies for all previously discussed variants.

Furthermore, in FIG. 13 there is shown by means of schematic lines Q, R and S that by using a conveyor belt or band 7 for the first spiked or toothed opening roller 1, a conveyor belt or band 7.2 for the second spiked or toothed opening roller 1 and a conveyor belt or band 7.3 depicted in broken lines for the third spiked or toothed opening roller 1 depicted in broken lines, the passes in the directions of to-and-fro travel A and B for each spiked or toothed opening roller 1 can be selected to have different lengths. This can be controlled by path limiting devices which will be discussed hereinbelow in more detail.

In this manner, it is possible that, for instance according to schematic line Q, the first spiked or toothed opening roller 1 extracts fiber flocks from two rows of fiber bales 3, the second spiked or toothed opening roller 1 extracts fiber flocks from three rows of fiber bales 3, and the third spiked or toothed opening roller 1 likewise extracts fiber flocks from three rows of fiber bales 3.

As possible variants, there could be arranged, according to schematic line R, that the first and second spiked or toothed opening rollers 1 each extract fiber flocks from four rows of fiber bales 3, while the third spiked or toothed opening roller 1 is either not provided or is located in a rest position.

According to the schematic line S, the sectioning is carried out in the following manner: three rows of fiber bales 3 for the first spiked or toothed opening roller 1, two rows of fiber bales 3 for the second spiked or toothed opening roller 1 and three rows of fiber bales 3 for the third spiked or toothed opening roller 1.

Furthermore, the conveyance of fiber flocks from the individual spiked or toothed opening rollers 1 can be effected either according to the full lines D, or according to the broken lines D.1, D.2 and D.3 to the conveyor belts or bands 7, 7.2 and 7.3, respectively, whereby conventional tube switches would be required. In this manner, there is the possibility of delivering fiber flocks from each row of fiber bales 3 to each of the conveyor belts or bands 7, 7.2 and 7.3.

Figure 14:
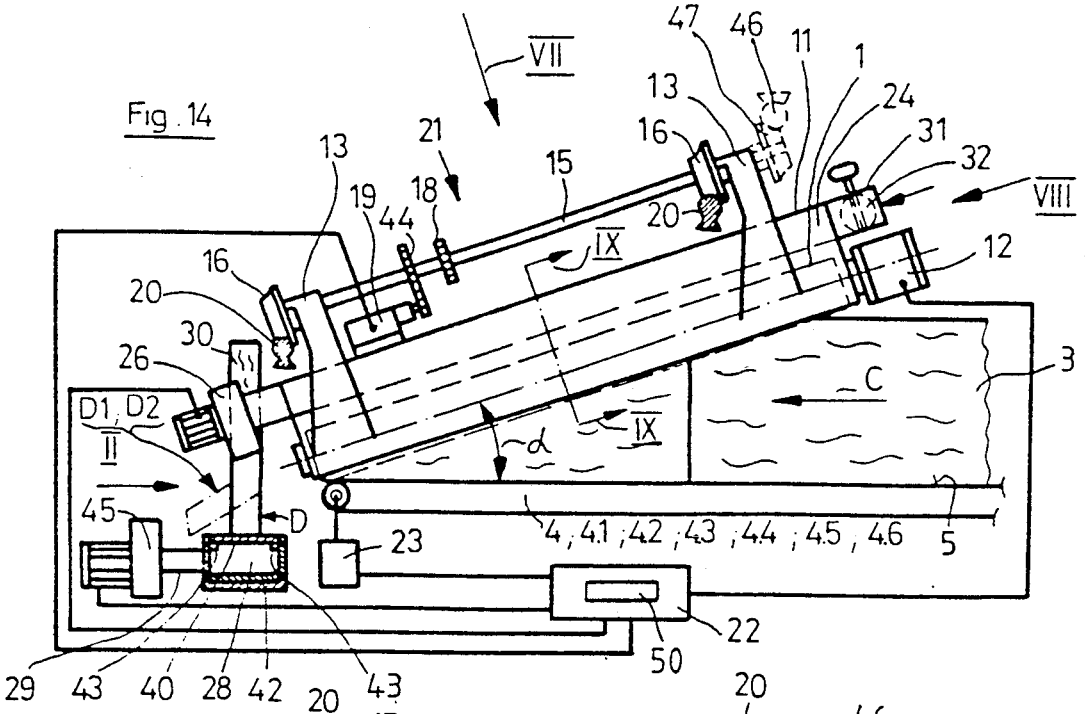
FIG. 14 schematically shows, in greater detail and on an enlarged scale, the apparatus depicted in FIG. 1.
Figure 15:
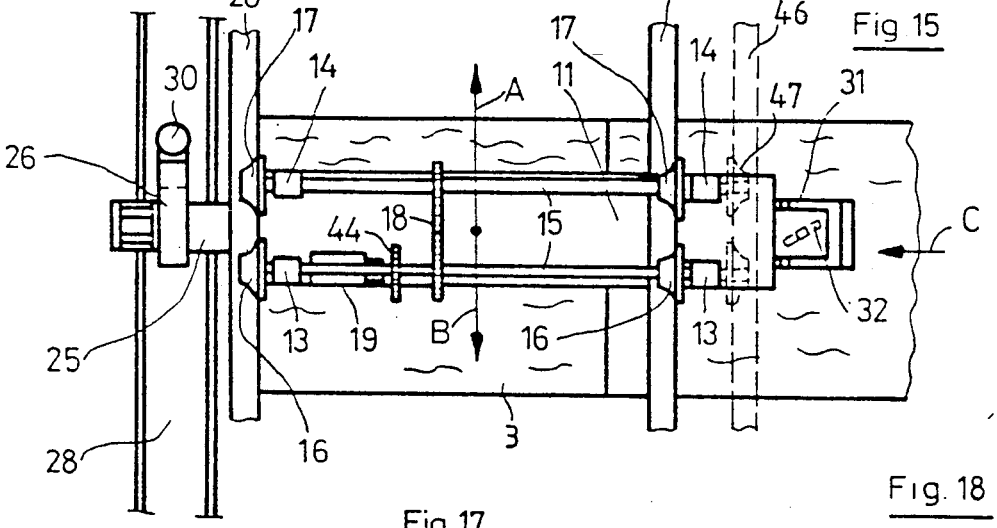
FIG. 15 schematically shows a top view of the apparatus depicted in FIG. 14, as viewed in the direction of the arrow VII indicated in FIG. 14.

FIG. 14 schematically shows an extraction member 21 in which the spiked or toothed opening roller 1 is rotatably and drivably mounted in a housing 11, whereby the spiked or toothed opening roller 1 is driven by a suitable electric motor 12 which is fixedly mounted at the housing 11.

Figure 18:
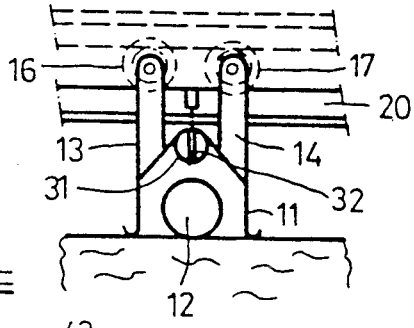
FIG. 18 schematically shows a detail of the apparatus depicted in FIG. 14, as viewed in the direction of the arrow VIII indicated in FIG. 14.

Furthermore, the housing 11 comprises two pairs of supports 13 and 14 in which there are rotatably mounted respective wheel shafts 15 which are secured against axial displacement. Only the one pair of supports 13 is visible in FIG. 14, while only one support of each of the pairs of supports 13 and 14 is visible in FIG. 18.

Wheels 16 and 17 provided with respective profiled treads are fixedly mounted at the wheel shafts 15 for rotation therewith. These wheels 16 and 17 are guided along respective tube-shaped guide tracks 20 for moving the housing 11 in the directions of to-and-fro travel A and B. One of the two wheel shafts 15 is driven by a suitable motor 19 by means of gear wheels 44, while the other wheel shaft 15 is driven by a suitable transmission 18. The drive motor 19 is fixedly mounted at the housing 11. A control unit 22 provided with a microprocessor 50 controls the motors 12 and 19 and a further suitable motor 23 which serves to drive the conveyor belt or band 4 and the individual conveyor belts or bands 4.1 through 4.6.

Furthermore, the housing 11 comprises a fiber-flock conveying channel 24 located above the spiked or toothed opening roller 1, an exit or outlet 25 of which is connected to a suitable fan 26. This fan 26 is advantageously constructed as a radial fan with an output end leading to a tube turn or elbow 27 which delivers the conveyed fiber flocks to a pneumatic conveyor channel 28.

This pneumatic conveyor channel 28 is, in turn, connected via a line or conduit 29 to a suitable fan 45 which conveys the fiber flocks to a suitable fiber-flock processing location not particularly shown in the drawings.

The pressure compensation between the radial fan 26 and the second fan 45 arranged downstream of the line or conduit 28 is effected by a compensation filter 30 by balancing the air pressure between the suction fan and the conveyor channel.

For controlling throughput of air through the fiber-flock conveying channel 24, there is provided a throttle valve or flap 32 at an inlet end 31 of the fiber-flock conveying channel 24.

The compensation filter 30, in turn, is mounted at a filter pipe 33 which is connected to the tube turn or elbow 27 in order to thereby provide a connection between the inner chamber of the tube turn or elbow 27 and the compensation filter 30.

The pneumatic conveyor channel 28 constitutes an alternative to the aforementioned conveyor belts or bands 7, 7.1, 7.2 and 7.3.

It is conceivable that as a variant, it is possible to do without the radial fan 26, so that the fiber flocks are transported by means of the airstream generated by the fan 45. A possible disadvantage of this simpler variant is that there prevails a possibly disadvantageous higher underpressure in the pneumatic conveyor channel 28. On the other hand, this variant has the advantage of providing a simpler and more economical construction, because not only the radial fan 26 but also the compensation filter 30 would be eliminated.

Figure 17:
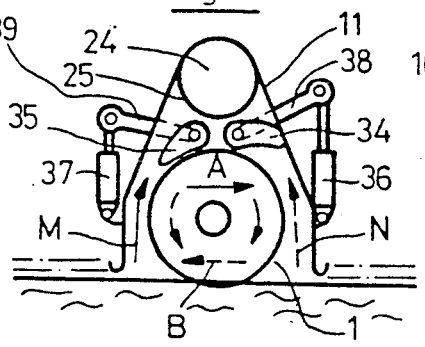
FIG. 17 schematically shows a sectional view through the apparatus depicted in FIG. 14 taken substantially along line IX—IX thereof.

As can be seen from FIG. 17, there are provided in the housing 11 flaps 34 and 35 between the spiked or toothed opening roller 1 and the fiber-flock conveying channel 24. These flaps 34 and 35 can selectively let through, depending on the direction of rotation of the spiked or toothed opening roller 1, conveying air together with extracted fiber flocks into the fiber-flock conveying channel 24 either in a direction of conveyance M or in a direction of conveyance N.

As depicted in FIG. 17, for the direction of rotation of the spiked or toothed opening roller 1 in clockwise direction and for the direction of travel of the extraction member 21 in the direction of travel A, the conveying airstream together with the extracted fiber flocks is conducted through the housing 11 in the direction of conveyance M. On the other hand, the conveying airstream and the fiber flocks are guided through the path in the direction of conveyance N when the spiked or toothed opening roller 1 rotates in counterclockwise direction and the extraction member 21 moves in the direction of travel B to extract fiber flocks from the extraction surface 6.

For actuating the flaps 34 and 35, there are provided respective pneumatic cylinders 36 and 37 which, on the one hand, are pivotable with the housing 11 and, on the other hand, are pivotably connected to respective pivot levers 38 and 39. The pivot levers 38 and 39 are thereby fixedly connected to the respective flaps 34 and 35 for displacement therewith.

Figure 16:
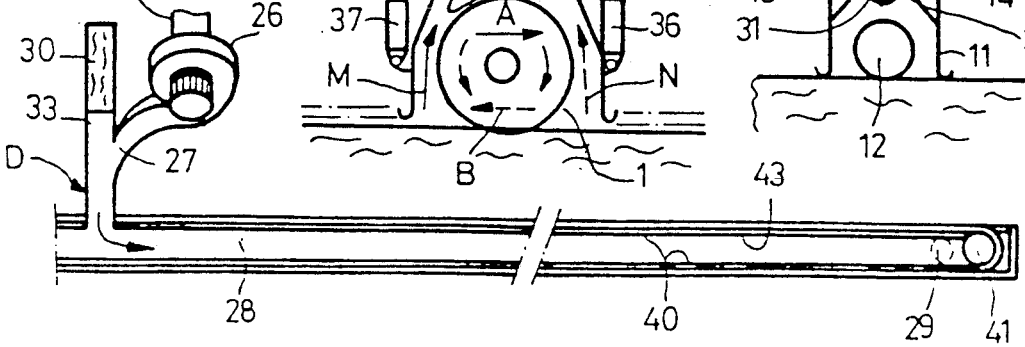
FIG. 16 schematically shows a detail of the apparatus depicted in FIG. 14, as viewed in the direction of the arrow II indicated in FIG. 1.

The pneumatic conveyor channel 28 comprises an endless belt or band 40 in order to support the tube turn or elbow 27 moved back and forth in the directions of to-and-fro travel A and B. The endless belt or band 40 is deflected at both ends of the pneumatic conveyor channel 28 around respective deflection rolls or rollers 41, of which only one of these deflection rolls or rollers 41 is visible in FIG. 16.

Within or between the two deflection rolls or rollers 41, a line or conduit 29 is connected to the conveyor channel 28. As can be seen from FIG. 14, the conveyor channel 28 comprises a substantially U-shaped trough 42 and the therein moving endless belt or band 40. In order to prevent the endless belt or band 40 from being sucked in by the underpressure prevailing in the pneumatic conveyor channel 28, the endless belt or band 40 is suitably supported by slide bars or rails 43.

In operation, the extraction member 21 is controlled by the control unit 22 to carry out the reciprocating movements in the directions of to-and-fro travel A and B, whereby the fiber bales 3 are simultaneously guided in the direction of travel or conveyance C toward the extraction element 21 by a step distance, for instance 3 mm to 5 mm, so that the spiked or toothed opening roller 1 is in the position to further extract fiber flocks from the extraction surface 6 and deliver the fiber flocks to the fiber-flock conveying channel 24.

The control unit 22 is thereby capable of adapting the step distance in the direction of travel or conveyance C, the reciprocating movements in the directions of to-and-fro travel A and B as well as the rotational speed of the spiked or toothed opening roller 1 to the respective fiber material of the fiber bales 3 in such a manner that the results obtained are those specified by one of ordinary skill in the art.

Furthermore, in the case of employing more than one extraction member 21, the control unit 22 is also capable of adapting in each case the step or incremental distance in the direction of travel or conveyance C of the individual conveyor belts or bands 4, on which the rows of fiber bales 3 are arranged, as well as the speed of to-and-fro motion or reciprocation in the directions of to-and-fro travel A and B and the rotational speeds of the spiked or toothed opening rollers 1, to the given or predetermined requirements of the individual rows of fiber bales 3, in order to thereby optimize the extraction results in the technological sense and/or relative to the fiber-flock mixtures of the individual rows of fiber bales 3.

In order to limit the different paths of the individual spiked or toothed opening rollers 1, i.e. of the extraction members 21, depicted in FIG. 13, there can be provided conventional and therefore not particularly illustrated end switches on or beside the tube-shaped guide tracks 20. Such switches can also be of a contactless design, so that such a contact element can be provided for each row of bales 3, the extraction member 21 travelling past the switch when the latter is not activated by the automatic control unit 22.

Furthermore, for the positions of the extraction member 21 shown in FIGS. 3 and 5 there should be a safety measure serving the purpose of maintaining the extraction member 21 guided on the tube-shaped guide tracks 20. Such a construction is shown by way of example in FIG. 14, in which one or two counter-tracks 46 guide wheels 47 freely rotating at the wheel shafts 15. These wheels 47 having profiled treads are secured at respective wheel shafts 15 against axial displacement.

The branch lines or tube switches indicated in FIG. 13 in dash-dot lines are designated by reference characters D1 and D2, of which only one is visible in FIG. 13.

Finally, the apparatus constructed according to the invention can be combined or augmented with features known to the art. For example, the spiked or toothed opening roller 1 can be provided with swash plates as disclosed, for example, in European Patent Application No. 058,751. Grid bars can be employed in combination with the spiked or toothed opening roller as disclosed in European Patent Application No. 0,199,041, or European Patent Application No. 0,351,529 or German Patent No. 3,827,517. Furthermore, there can be used two rollers as disclosed in European Patent Application No. 0,326,913. In the case of two extraction rollers, there can be used flaps as described, for example in German Patent No. 3,843,656.

While there are shown and described present preferred embodiments of the invention, it is to be distinctly understood that the invention is not limited thereto, but may be otherwise variously embodied and practiced within the scope of the following claims.

What we claim is:

1. A method of extracting fiber flocks from fiber bales, comprising the steps of:

serially disposing on a supporting surface a plurality of fiber bales in a row which has a predetermined longitudinal direction by providing at least two rows of fiber bales disposed parallel to each other;

moving an extraction member to-and-fro over an extraction surface of the serially disposed fiber bales;

said step of moving the extraction member entailing moving a spiked opening roller which has tooth-like spikes and an axis of rotation and two directions of rotations, according to said to-and-fro movement;

said step of moving the spiked opening roller entailing the step of extracting fiber flocks from the extraction surface by means of the tooth-like spikes in both directions of rotation and the further step of delivering extracted fiber flocks to a fiber-flock conveyance;

moving the plurality of fiber bales of each row of fiber bales by steps in a predetermined direction toward the extraction member;

orienting the axis of rotation of the spiked opening roller with respect to the supporting surface for the serially disposed fiber bales such that the axis of rotation forms with the supporting surface a predetermined nonzero, and non 90°, angle of inclination; and said step of moving the extraction member to-and-fro over the extraction surface of the serially disposed fiber bales entailing determining the direction of to-and-fro travel of the extraction member over the extraction surface of the fiber bales such that the direction of to-and-fro travel of the extraction member is substantially transverse to the predetermined longitudinal direction of the row of the plurality of fiber bales;

transporting the fiber flocks in a direction parallel to the axis of rotation of said opening roller, directly to a further conveyor, and transporting the fiber flocks to a subsequent processing step.

2. The method as defined in claim 1, wherein:
said step of orienting the axis of rotation of the spiked opening roller with respect to the supporting surface for the serially disposed fiber bales entails forming between the axis of rotation and the supporting surface a predetermined nonzero angle of inclination between 10° and 170°.

3. The method as defined in claim 1, wherein:
said step of orienting the axis of rotation of the spiked opening roller with respect to the supporting surface for the serially disposed fiber bales entails forming between the axis of rotation and the supporting surface a predetermined nonzero angle of inclination between 10° and 45°.

4. The method as defined in claim 1, wherein:
said step of orienting the axis of rotation of the spiked opening roller with respect to the supporting surface for the serially disposed fiber bales entails forming between the axis of rotation and the supporting surface a predetermined nonzero angle of inclination between 40° and 120°.

5. The method as defined in claim 1, wherein:
said step of orienting the axis of rotation of the spiked opening roller with respect to the supporting surface for the serially disposed fiber bales entails forming between the axis of rotation and the supporting surface a predetermined nonzero angle of inclination between 25° and 35°.

6. The method as defined in claim 1, wherein:
said step of serially disposing on a supporting surface a plurality of fiber bales in a row entails providing fiber bales having a bale height, a bale width and a bale length and disposing the fiber bales in upright position on the supporting surface.

7. The method as defined in claim 6, wherein:
said step of disposing the fiber bales in upright position on the supporting surface entails disposing the fiber bales such that the bale length is oriented substantially parallel to the predetermined longitudinal direction of the row of the plurality of fiber bales.

8. The method as defined in claim 6, wherein:
said step of disposing the fiber bales in upright position on the supporting surface entails disposing the fiber bales such that the bale length is oriented substantially perpendicular to the predetermined longitudinal direction of the row of the plurality of fiber bales.

9. The method as defined in claim 1, wherein:
said step of serially disposing on a supporting surface a plurality of fiber bales in a row entails providing fiber bales having a bale height, a bale width and a bale length and disposing the fiber bales in horizontal position on the supporting surface.

10. The method as defined in claim 9, wherein:
said step of disposing the fiber bales in horizontal position on the supporting surface entails disposing the fiber bales such that the bale length is oriented substantially parallel to the predetermined longitudinal direction of the row of the plurality of fiber bales.

11. The method as defined in claim 9, wherein:
said step of disposing the fiber bales in horizontal position on the supporting surface entails disposing the fiber bales such that the bale length is oriented substantially perpendicular to the predetermined longitudinal direction of the row of the plurality of fiber bales.

12. The method as defined in claim 1, wherein:
said step of extracting fiber flocks from the extraction surface entails simultaneously extracting fiber flocks from the extraction surface with more than one spiked opening roller.

13. The method as defined in claim 12, wherein:
said step of simultaneously extracting fiber flocks with more than one spiked opening roller entails simultaneously extracting fiber flocks from the same extraction surface.

14. The method as defined in claim 13, wherein:
said step of simultaneously extracting fiber flocks from the same extraction surface entails simultaneously extracting with the same extraction depth.

15. The method as defined in claim 13, wherein:
said step of simultaneously extracting fiber flocks from the same extraction surface entails simultaneously extracting with different extraction depths.

16. The method as defined in claim 12, wherein:
said step of simultaneously extracting fiber flocks with more than one spiked opening roller entails simultaneously extracting fiber flocks from more than one extraction surface.

17. The method as defined in claim 16, wherein:
said step of simultaneously extracting fiber flocks from more than one extraction surface entails simultaneously extracting with the same extraction depth.

18. The method as defined in claim 16, wherein:
said step of simultaneously extracting fiber flocks from more than one extraction surface entails simultaneously extracting with different extraction depths.

19. The method as defined in claim 16, further including the step of:
variably controlling the length of the travel in either direction of to-and-fro motion of the spiked opening rollers extracting fiber flocks from more than one extraction surface.

20. The method as defined in claim 16, wherein:
said step of simultaneously extracting fiber flocks with more than one spiked opening roller and said step of simultaneously extracting fiber flocks from more than one extraction surface entail controlling each spiked opening roller so as to extract fiber flocks from a variable number of rows of fiber bales.

21. The method as defined in claim 16, further including the step of:
rearwardly moving rows of bales, from which no fiber flocks are extracted, by a predetermined distance in a predetermined direction away from respective spiked opening rollers.

22. The method as defined in claim 12, wherein:
said step of simultaneously extracting fiber flocks from the extraction surface with more than one spiked opening roller entails simultaneously extracting fiber flocks with spiked opening rollers forming the same nonzero angle of inclination with the supporting surface.

23. The method as defined in claim 12, wherein:
said step of simultaneously extracting fiber flocks from the extraction surface with more than one spiked opening roller entails simultaneously extracting fiber flocks with spiked opening rollers forming different nonzero angles of inclination with the supporting surface.

24. The method as defined in claim 12, wherein:

said step of simultaneously extracting fiber flocks from the extraction surface with more than one spiked opening roller entails simultaneously extracting fiber flocks with the same extraction output.

25. The method as defined in claim 12, wherein:

said step of simultaneously extracting fiber flocks from the extraction surface with more than one spiked opening roller entails simultaneously extracting fiber flocks with different extraction outputs.

26. The method as defined in claim 1, wherein:

said step of delivering extracted fiber flocks to a fiber-flock conveyance entails controllably predetermining variable delivery of extracted fiber flocks to more than one fiber-flock conveyance.

27. The method as defined in claim 1, wherein:

said step of serially disposing on a supporting surface a plurality of fiber bales in a row entails disposing fiber bales of the same provenance on the supporting surface.

28. The method as defined in claim 1, wherein:

said step of serially disposing on a supporting surface a plurality of fiber bales in a row entails disposing fiber bales of different provenances in a predetermined sequence on the supporting surface.

29. The method as defined in claim 1, wherein:

said step of serially disposing on a supporting surface a plurality of fiber bales in a row entails disposing side-by-side a plurality of rows of fiber bales on the supporting surface; and said step of disposing side-by-side a plurality of rows of fiber bales entailing providing rows of fiber bales of the same provenance selectively in parallel with rows of fiber bales of different provenances.

30. An apparatus for extracting fiber flocks from fiber bales, comprising:

an extraction member for fiber-flock extraction;

the fiber bales having an extraction surface;

guide means for guiding said extraction member over said extraction surface;

said extraction member being reciprocatingly movable at said guide means for to-and-fro travel over said extraction surface of the fiber bales in order to extract fiber flocks from the fiber bales;

a supporting surface for the fiber bales;

said supporting surface for the fiber bales being displaceable in a predetermined direction of travel;

said guide means for guiding said extraction member being oriented in a direction substantially transverse to said predetermined direction of travel of said supporting surface for the fiber bales; and said to-and-fro travel of said extraction member defining a path lying in a direction substantially perpendicular to said predetermined direction of travel of said supporting surface for the fiber bales;

means for reciprocatingly moving said extraction member along said guide means;

said extraction member comprising a spiked opening roller for engaging said extraction surface of the fiber bales;

said extraction member further comprising a housing;

said spiked opening roller having a predetermined axis of rotation and being rotatably and drivably mounted in said housing;

said housing being movable together with said spiked opening roller and being guided at said guide means such that said predetermined axis of rotation of said spiked opening roller forms with said supporting surface for the fiber bales a nonzero angle and a non 90° angle;

said housing comprising fiber-flock conveying means for receiving fiber flocks extracted by said spiked opening roller; and said fiber-flock conveying means being arranged substantially parallel to said spiked opening roller and being structured to receive fiber flocks along substantially the entire length of the spiked opening roller and to convey the received fiber flocks in a direction parallel to the spiked opening roller directly to a further conveyor, for transporting the fiber flocks to a subsequent processing step.

31. The apparatus as defined in claim 30, wherein:

said fiber-flock conveying means constitute a fiber-flock conveying channel.

32. The apparatus as defined in claim 31, wherein:

said spiked opening roller is rotatable about said predetermined axis of rotation in both directions of rotation; and said spiked opening roller being constructed to extract fiber flocks from said extraction surface of the fiber bales in said both directions of rotation.

33. The apparatus as defined in claim 32, further including:

means for fiber-flock conveyance from said spiked opening roller to said fiber-flock conveying channel according to the respective direction of rotation of said spiked opening roller; and said fiber-flock conveying channel being constructed to receive fiber flocks extracted by said spiked opening roller rotating in either of said both directions of rotation.

34. The apparatus as defined in claim 33, wherein:

said means for fiber-flock conveyance from said spiked opening roller to said fiber-flock conveying channel comprise two flaps arranged within said housing and between said spiked opening roller and said fiber-flock conveying channel;

one of said two flaps being provided for admitting a fiber-flock stream arriving from said spiked opening roller rotating in one of said both directions of rotation; and the other one of said two flaps being provided for admitting a fiber-flock stream arriving from said spiked opening roller rotating in the other one of said both directions of rotation.

35. The apparatus as defined in claim 31, further including:

a conveyor channel in which underpressure prevails; and said fiber-flock conveying channel leading into said conveyor channel.

36. The apparatus as defined in claim 30, further including:

a control unit for controlling the extraction of the fiber flocks.

37. The apparatus as defined in claim 36, wherein:

said control unit is provided with a microprocessor for carrying out said fiber-flock extraction.

38. The apparatus as defined in claim 30, further including:

at least one tube switch arranged downstream of said fiber-flock conveying channel;

means of conveyance for the fiber flocks; and said at least one tube switch diverting the fiber-flock stream to said means of conveyance.

39. An apparatus for extracting fiber flocks from fiber bales, comprising:

an extraction member for fiber-flock extraction;

the fiber bales having an extraction surface;

guide means for guiding said extraction member over said extraction surface;

said extraction member being reciprocatingly movable at said guide means for to-and-fro travel over said extraction surface of the fiber bales in order to extract fiber flocks from the fiber bales;

a supporting surface for the fiber bales;

said supporting surface for the fiber bales being displaceable in a predetermined direction of travel;

said guide means for guiding said extraction member being oriented in a direction substantially transverse to said predetermined direction of travel of said supporting surface for the fiber bales; and said to-and-fro travel of said extraction member defining a path lying in a direction substantially perpendicular to said predetermined direction of travel of said supporting surface for the fiber bales;

means for reciprocatingly moving said extraction member along said guide means;

said extraction member comprising a spiked opening roller for engaging said extraction surface of the fiber bales;

said extraction member further comprising a housing;

said spiked opening roller having a predetermined axis of rotation and being rotatably and drivably mounted in said housing;

said housing being guided at said guide means such that said predetermined axis of rotation of said spiked opening roller forms with said supporting surface for the fiber bales a nonzero angle;

said housing comprising fiber-flock conveying means for receiving fiber flocks extracted by said spiked opening roller; and said fiber-flock conveying means being arranged substantially parallel to said spiked opening roller and being structured to convey the received fiber flocks;

said fiber-flock conveying means constitute a fiber-flock conveying channel;

said fiber-flock conveying channel conveying an air inlet located beyond the fiber-flock conveying stream; and said air inlet being provided with a throttle flap for quantitative determination of the air drawn-in through said air inlet.

40. An apparatus for extracting fiber flocks from fiber bales, comprising:

an extraction member for fiber-flock extraction;

the fiber bales having an extraction surface;

guide means for guiding said extraction member over said extraction surface;

said extraction member being reciprocatingly movable at said guide means for to-and-fro travel over said extraction surface of the fiber bales in order to extract fiber flocks from the fiber bales;

a supporting surface for the fiber bales;

said supporting surface for the fiber bales being displaceable in a predetermined direction of travel;

said guide means for guiding said extraction member being oriented in a direction substantially transverse to said predetermined direction of travel of said supporting surface for the fiber bales;

said to-and-fro travel of said extraction member defining a path lying in a direction substantially perpendicular to said predetermined direction of travel of said supporting surface for the fiber bales;

means for reciprocatingly moving said extraction member along said guide means;

said extraction member comprising a spiked opening roller for engaging said extraction surface of the fiber bales;

said extraction member further comprising a housing;

said spiked opening roller having a predetermined axis of rotation and being rotatably and drivably mounted in said housing;

said housing being guided at said guide means such that said predetermined axis of rotation of said spiked opening roller forms with said supporting surface for the fiber bales a nonzero angle;

said housing comprising fiber-flock conveying means for receiving fiber flocks extracted by said spiked opening roller; and said fiber-flock conveying means being arranged substantially parallel to said spiked opening roller and being structured to convey the received fiber flocks;

said fiber-flock conveying means constitute a fiber-flock conveying channel;

said apparatus further including:

a conveyor channel in which underpressure prevails; and said fiber-flock conveying channel leading into said conveying channel;

a suction fan and a pressure compensation filter arranged between said fiber-flock conveying channel and said conveyor channel; and said pressure compensation filter balancing the air pressure between said suction fan and said conveyor channel.

41. An apparatus for extracting fiber flocks from fiber bales, comprising:

an extraction member for fiber-flock extraction;

the fiber bales having an extraction surface;

guide means for guiding said extraction member over said extraction surface;

said extraction member being reciprocatingly movable at said guide means for to-and-fro travel over said extraction surface of the fiber bales in order to extract fiber flocks from the fiber bales;

a supporting surface for the fiber bales;

said supporting surface for the fiber bales being displaceable in a predetermined direction of travel;

said guide means for guiding said extraction member being oriented in a direction substantially transverse to said predetermined direction of travel of said supporting surface for the fiber bales;

said to-and-fro travel of said extraction member defining a path lying in a direction substantially perpendicular to said predetermined direction of travel of said supporting surface for the fiber bales;

means for reciprocatingly moving said extraction member along said guide means;

said extraction member comprising a spiked opening roller for engaging said extraction surface of the fiber bales;

said extraction member further comprising a housing;

said spiked opening roller having a predetermined axis of rotation and being rotatably and drivably mounted in said housing;

said housing being guided at said guide means such that said predetermined axis of rotation of said spiked opening roller forms with said supporting surface for the fiber bales a nonzero angle;

said housing comprising fiber-flock conveying means for receiving fiber flocks extracted by said spiked opening roller; and said fiber-flock conveying means being arranged substantially parallel to said spiked opening roller and being structured to convey the received fiber flocks;

said fiber-flock conveying means constitute a fiber-flock conveying channel;

said apparatus further including:

a conveyor channel in which underpressure prevails; and said fiber-flock conveying channel leading into said conveying channel;

distribution means arranged downstream of said fiber-flock conveying means; and said distribution means selectively guiding extracted fiber flocks in a predetermined direction.

42. The apparatus as defined in claim 41, wherein:

said distribution means comprises at least one tube switch arranged downstream of said fiber-flock conveying channel and upstream of said conveyor channel;

said at least one tube switch diverting the fiber-flock stream to said conveyor channel.

43. An apparatus for extracting fiber flocks from fiber bales, comprising:

an extraction member for fiber-flock extraction;

the fiber bales having an extraction surface;

guide means for guiding said extraction member over said extraction surface;

said extraction member being reciprocatingly movable at said guide means for to-and-fro travel over said extraction surface of the fiber bales in order to extract fiber flocks from the fiber bales during said to-and-fro travel of said extraction member;

a plurality of supporting surfaces for serially supporting a plurality of rows of fiber bales, each of said plurality of supporting surfaces being displaceable in a predetermined direction of travel;

said guide means for guiding said extraction member being oriented in a direction substantially transverse to said predetermined direction of travel of said supporting surfaces for the fiber bales;

said to-and-fro travel of said extraction member defining a path lying in a direction substantially perpendicular to said predetermined direction of travel of said supporting surface for the fiber bales; and a fiber flock conveyor being connected to said extraction member for receiving the fiber flocks being extracted in said path defined by said to-and-fro travel of said extraction member and transporting the fiber flocks in a direction parallel to said extraction member.

44. The apparatus as defined in claim 43, wherein:

at least two of said plurality of supporting surfaces are arranged one above the other.

45. A method of extracting fiber flocks from fiber bales, comprising the steps of:

serially disposing on a supporting surface a plurality of fiber bales in a row which has a predetermined longitudinal direction by providing at least two rows of fiber bales serially disposed on respective supporting surfaces arranged one above the other;

moving an extraction member to-and-fro over an extraction surface of the serially disposed fiber bales;

said step of moving the extraction member entailing moving a spiked opening roller which has tooth-like spikes and an axis of rotation;

said step of moving the spiked opening roller entailing the step of extracting fiber flocks from the extraction surface by means of the tooth-like spikes and the further step of delivering extracted fiber flocks to a fiber-flock conveyance;

moving the plurality of fiber bales by steps in a predetermined direction toward the extraction member;

orienting the axis of rotation of the spiked opening roller with respect to the supporting surface for the serially disposed fiber bales such that the axis of rotation forms with the supporting surface a predetermined nonzero angle of inclination; and said step of moving the extraction member to-and-fro over the extraction surface of the serially disposed fiber bales entailing determining the direction of to-and-fro travel of the extraction member over the extraction surface of the fiber bales such that the direction of to-and-fro travel of the extraction member is substantially transverse to the predetermined longitudinal direction of the row of the plurality of fiber bales.

* * * * *